United States Patent [19]

Anenberg

[11] Patent Number: 4,969,267

[45] Date of Patent: Nov. 13, 1990

[54] DOUBLE-BLADED KNIFE FOR DICING AND OTHER CUTTING ACTION FOR VEGETABLES, MEATS AND OTHER FOODS

[76] Inventor: Harry Anenberg, 3313 Lester Rd., Philadelphia, Pa. 19154

[21] Appl. No.: 433,313

[22] Filed: Nov. 8, 1989

[51] Int. Cl.[5] ..... B26B 3/00

[52] U.S. Cl. ..... 30/304; 30/344

[58] Field of Search ..... 30/304, 305, 299, 340, 30/329, 339, 114, 344

[56] References Cited

U.S. PATENT DOCUMENTS 1,665,064 4/1928 Magrath ..... 30/304
1,697,091 1/1929 Skubil ..... 30/304
2,448,383 8/1948 Mathaus ..... 30/304
2,690,616 10/1954 Brubaker ..... 30/304

*Primary Examiner*—Douglas D. Watts
*Attorney, Agent, or Firm*—Caesar, Rivise, Bernstein, Cohen & Pokotilow, Ltd.

[57] ABSTRACT

An apparatus for manually cutting, chopping and dicing vegetables, meats and a variety of other foods comprising a plurality of blades attached to a handle. In one embodiment the blades are secured to a common base which is attached to either a one or two piece handle. In a second embodiment the blades are releasably secured to a common base which is attached to either a one or two piece handle. The blades may be tapered to a point at the distal end.

1 Claim, 1 Drawing Sheet

DOUBLE-BLADED KNIFE FOR DICING AND OTHER CUTTING ACTION FOR VEGETABLES, MEATS AND OTHER FOODS

This invention relates generally to cutlery and more particularly to hand-held kitchen cutlery for manually cutting, chopping and dicing vegetables, meats and a variety of other foods.

BACKGROUND OF THE INVENTION

Numerous types of hand-held cutlery and devices have been used which utilize a single blade attached to a handle for slicing, chopping and dicing a wide variety of foods. One of the most commonly used utensils is the chef's knife which contains a sharp blade of varying lengths secured to a wooden or plastic handle.

The blade in such a knife is usually made from a wide variety of suitable materials such as high carbon steel, permitting the blade to easily cut through food and yet retain its sharpness. The blade may be secured to either a solid handle or a riveted between a two-piece handle.

In order to more quickly chop vegetables such as parsley, celery, onions, or other foodstuffs, cooks oftentimes hold the handles of two knives in one hand, side by side, to simultaneously utilize two cutting blades, thereby decreasing the amount of effort needed to obtain the desired product.

In addition, this method of cutting permits the parallel blades to more readily localize the food between the blades, thereby preventing the food or other substance from spreading out over a large surface area of a cutting board or other material.

Although this method of cutting substantially decreases a user's work time and effort expended, it is extremely dangerous due to a lack of control of the knives. Often, the blades of the knives contact a piece of food or material which is difficult to cut causing the knives to slip out of the user's hand or the user will simply lose a firm grip on the multiple knives used due to the hand fatigue the user often experiences when gripping multiple handles. The end result is that the user is inevitably lacerated on the fingers or hands, oftentimes severely.

OBJECTS OF THE INVENTION

Accordingly, it is a general object of this invention to provide an apparatus which overcomes the disadvantages of the prior art.

It is a further object of this invention to provide an apparatus for quickly and safely cutting, chopping and dicing foodstuffs or other materials.

SUMMARY OF THE INVENTION

These and other objects of this invention are achieved by providing an apparatus for cutting, chopping, dicing and ricing vegetables, meat and other foodstuffs and materials in a more efficient and safe manner.

In the first embodiment, the apparatus comprises two cutting blades which may be attached to a common base via welding or other means, the base being attached to a handle. The base may be attached to a solid one-piece handle or may be secured two a two-piece handle by riveting or other means.

In a second embodiment, the apparatus comprises two cutting blades which may be releasably secured to a common base by a bolt or other means. The common base may be secured to either a one or two piece handle.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
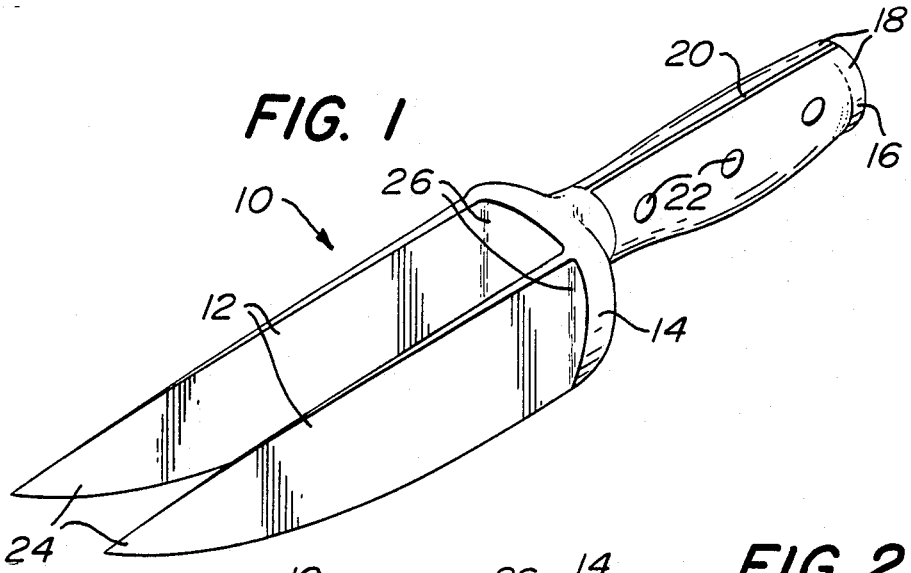
FIG. 1 is a three-dimensional view showing a first embodiment of the invention.
Figure 2:
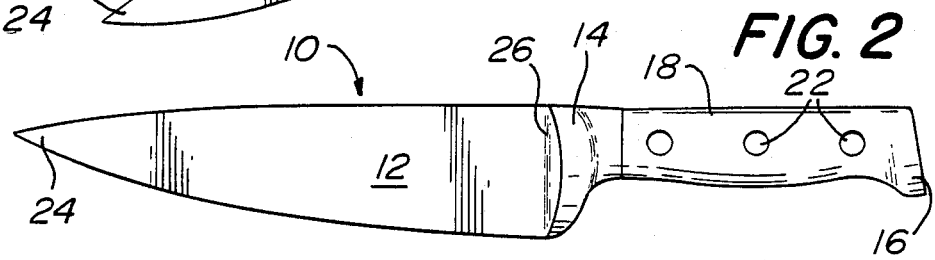
FIG. 2 is an elevational view of the embodiment shown in FIG. 1.

Referring now to the various figures of the drawings where like reference numerals refer to like parts, there is shown at 10 in FIG. 1 apparatus constructed in accordance with the subject invention. In the first embodiment of the apparatus 10 shown in FIG. 1 the apparatus basically comprises a plurality of blades 12 secured to a handle 16.

The adjacent end 26 of the blades 12 may be connected to a common base 14 having an elongated member 20 (commonly known as a tang) for connecting the blades 12 to the handle 16. The distal end 24 of the blades 12 are preferentially tapered to a point. The blades 12 may be comprised of any suitable material, however high carbon steel is preferable as it retains the sharpness of its cutting edge longer and is quickly sharpened, does not easily rust or pit, is simple to clean.

The adjacent end 26 of the blades may be connected to the common base 14 by any means, however, welding is preferable to maintain a more permanent bond. The common base 14 may be joined to the elongated member 20 by welding or any other suitable connecting means or may comprise one piece. The base 14 as well as the elongated member 20 may be comprised of any suitable material which may be the same or different material that the blades 12 are formed from. As may be appreciated by one skilled in the art, more than two blades may be utilized to further increase the efficiency of cutting.

Figure 3:
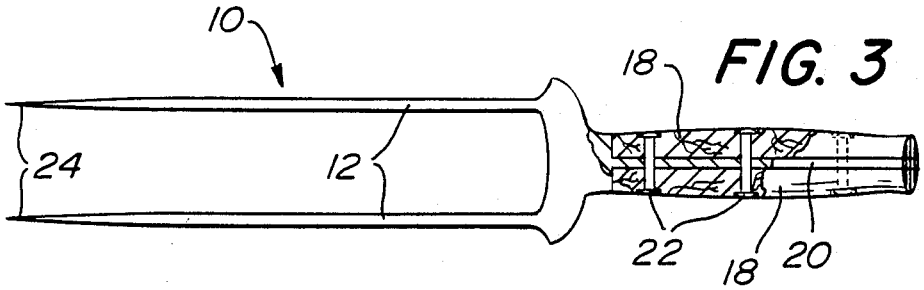
FIG. 3 is a top planar view of the embodiment of FIG. 1 with the handle partially cut away.
Figure 4:
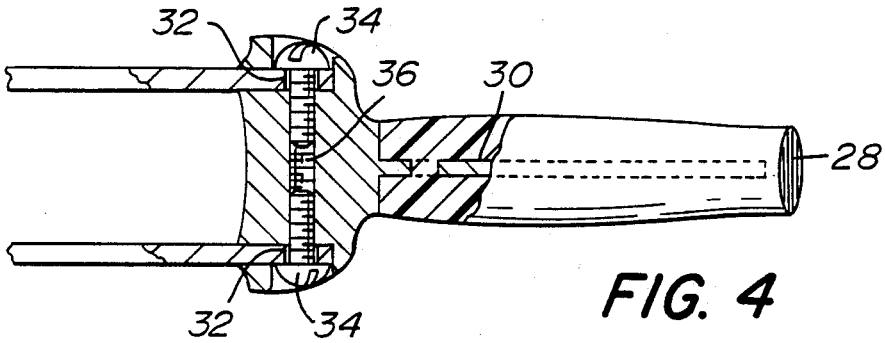
FIG. 4. is a fragmentary top planar view of a second embodiment of the invention with portions cut away.

The handle 16 may comprise a one-piece member 28 as shown in FIG. 4 or may comprise a plurality of pieces 18 as shown in FIGS. 1 and 3. It should be readily apparent to those skilled in the art that either form of the handle may be used with the embodiments disclosed herein.

The handle in either form may be comprised of any suitable material such as wood or metal. However, it is preferable to use a non-staining plastic such as polypropylene which is easier to clean and maintain, thereby minimizing the risk of bacteria accumulation, is comfortable to the hand, decreasing frictional irritation, and has increased durability.

As shown in FIG. 4, the one-piece handle 28 contains an elongated hole 30 for receiving the elongated section 20. The elongated section 20 may be secured to the handle 28 by any number of means, including as an example, the use friction, or of an adhesive (not shown).

The handle 16 shown in FIG. 3 comprises a plurality of pieces 18 secured on each side of the elongated section 20 which by one or a number of rivets 22 passing through the elongated section 20 as well as through the pieces 18. Alternatively the pieces 18 may be joined to the elongated section 20 by any of the standard methods in the industry such as by use of an adhesive or other means.

In a second embodiment of the invention as shown in FIG. 4, the blades 12 are releasably secured to the handle 28. The adjacent end 26 of each of the blades 12 contains a hole 32 for receiving a retaining means such as a bolt 34 to secure the blade to the handle 28.

In the embodiment shown in FIG. 4, the adjacent end 26 of each of the blades is releasably secured via the bolt 34 to the common base 14 which has a chamber 36 for receiving the bolt 34. Preferably the chamber 36 is threaded so as to permit the bolt 34 to be directly connected to the common base 14 without the use of a nut, friction or other means.

This embodiment permits the blades to be easily replaced should the wear out or become damaged. Furthermore, as there is no need to weld the blades 12, to the common base 14, this embodiment is less expensive to manufacture.

The apparatus 10 may be stored in a generally available knife rack (not shown), by placing the blades 12 through a material such as plastic which frictionally supports each of the blades so that the edge of each the blades is located within a protective cavity. Each of the protective cavities preferentially contains a sharpening stone or other material which automatically sharpens the blades each time they are placed in or removed from the cavity.

Without further elaboration the foregoing will so fully illustrate my invention that others may, by applying current or future knowledge, readily adapt the same for use under various conditions of service.

I claim:

1. An apparatus for cutting a foodstuff comprising handle means and cutting means extending from said handle means, said cutting means being secured to said handle means in a T-shaped common base extending from said handle means said common base being a material different from said cutting means, said cutting means being of an elongated shaped and comprising at least two sharp parallel blades wherein the cutting edge runs along the length of said blades, said blades being secured to said common base by a releasable securing means comprising at least one bolt threaded into said common base, and wherein each of said blades possesses a distal end and an adjacent end, said adjacent ends having a threaded hole to receive at least one bolt threaded through said common base and means to tighten the bolt within the common base to hold a portion of the blades tightly against the common base to achieve a strong assembly wherein the blades are easily replaced.

* * * * *